US006645920B1

(12) United States Patent
Butke

(10) Patent No.: US 6,645,920 B1
(45) Date of Patent: Nov. 11, 2003

(54) ADDITIVE COMPOSITION FOR INDUSTRIAL FLUID

(75) Inventor: Betsy J. Butke, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/294,104

(22) Filed: Nov. 14, 2002

(51) Int. Cl.[7] ..... C10M 141/06; C10M 141/10

(52) U.S. Cl. ..... 508/282; 508/410; 508/436; 508/563; 508/569

(58) Field of Search ..... 508/282, 408, 508/410, 436, 563, 569

(56) References Cited

U.S. PATENT DOCUMENTS

| | | | | |
|---|---|---|---|---|
| 3,819,718 A | | 6/1974 | Okumura et al. | 260/609 B |
| 4,088,587 A | | 5/1978 | Lowe | 252/32.7 E |
| 4,101,429 A | | 7/1978 | Birke | 252/32.7 E |
| 4,161,451 A | | 7/1979 | Lowe | 252/32.7 E |
| 4,163,731 A | | 8/1979 | Randell et al. | 252/78.5 |
| 4,701,273 A | * | 10/1987 | Brady et al. | 508/281 |
| 5,091,099 A | | 2/1992 | Evans et al. | 252/48.6 |
| 5,342,531 A | * | 8/1994 | Walters et al. | 508/272 |
| 5,730,906 A | | 3/1998 | Berlowitz | 252/399 |
| 5,840,662 A | | 11/1998 | Nibert et al. | 508/291 |
| 6,180,575 B1 | | 1/2001 | Nipe | 508/227 |
| 6,358,896 B1 | | 3/2002 | Gutierrez et al. | 508/501 |

FOREIGN PATENT DOCUMENTS

| | | |
|---|---|---|
| EP | 0531585 B1 | 3/1993 |
| EP | 0978554 A2 | 2/2000 |

OTHER PUBLICATIONS

ASTM Designation D 665–99, "Standard Test Method for Rust–Preventing Characteristics of Inhibited Mineral Oil in the Presence of Water", ASTM, 1999.

ASTM Designation D 2272–98, "Standard Test Method for Oxidation Stability of Steam Turbine Oils by Rotating Pressure Vessel", ASTM, 1998.

"Lubricating Oil Recommendations for Gas Turbines with Bearing Ambients Above (500°C)", GE Power Systems, No. GEK–32568E, May 1999.

"7F. Turbine Oil", *Opportunities in Lubricants*, vol. III—Industrial Oils and Fluids, pp. 1–8 (Kline & Company, Inc. 1993).

* cited by examiner

*Primary Examiner*—Jacqueline V. Howard
(74) *Attorney, Agent, or Firm*—Teresan W. Gilbert; Michael F. Esposito

(57) ABSTRACT

A lubricating oil composition containing in oxidation inhibitor package, a rust inhibitor and metal deactivator is used in industrial fluids. The oxidation package contains alkylated diphenylamines, substituted hydrocarbyl monosulphides and optionally sterically hindered phenols. The rust inhibitor contains at least 1 of alkylated amine salts of alkylphosphoric acid, dialkyldithiophosphoric acid or hydrocarbyl aryl sulphonic acids. The metal deactivator is 5-methylbenzotriazole.

20 Claims, No Drawings

ADDITIVE COMPOSITION FOR INDUSTRIAL FLUID

FIELD OF THE INVENTION

The present invention relates to the use of an additive composition that contains at least two antioxidants and at least one rust inhibitor in lubricating oils. The invention further relates to the process to make the novel additive composition and its use in industrial fluids.

BACKGROUND OF THE INVENTION

Protecting against oxidation degradation by selecting the proper balance of oxidation inhibitor components can significantly improve the life of a lubricant. Oxidation occurs when oxygen attacks the petroleum fluid, which leads to increased viscosity and deposit formation in the fluid. The oxidation process contributes to the formation of sludge in oils and the breakdown of viscosity characteristics of the lubricant.

Rust inhibitors primarily protect against seizure, rust and corrosion by preventing the oxidation of iron in steel. Selecting the propel balance of rust inhibitor components can significantly improve the life of a lubricant. Often rust inhibitors contain carboxylic functionality and are described as acidic. Common acidic rust inhibitors are derivatives of alkenyl succinic anhydride, particularly polyisobutene succinic anhydride. Polyisobutene succinic anhydrides used as rust inhibitors react with divalent metals such as calcium and/or zinc from metal detergents or other metal contaminants to produce sludge and other particulate matter. Sludge and other particulate matter are detrimental in industrial fluid systems.

U.S. Pat. No. 4,101,429 exhibits the problems associated with rust inhibitors containing polyisobutene succinic anhydrides mentioned above. The technology disclosed relates to the use of polyisobutene succinic anhydride in combination with zinc primary dihydrocarbyl dithiophosphate in turbine oils to produce a formulation with acceptable levels of thermal stability, oxidation stability, low wear, water compatibility and filtration properties. However the polyisobutene succinic anhydride reacts with metal detergents or other metal contaminants to produce particulate material that accumulates and results in plugging the fine filters used in turbine oils.

European Patent Number 978,554 discloses the use of a lubricating oil composition suitable for turbines with improved wet filterability containing at least one neutral rust inhibitor to prevent oxidation and rust. Rust inhibitors used in this invention include hydrocarbyl esters such as R (COOR')n, in which R and R' are each independently hydrocarbyl groups, or hydroxyhydrocarbyl groups, containing up to about 40 carbon atoms, and n is 1 to 4. Other neutral rust inhibitors are aspartic acid diesters of 1-(2-hydroxyethyl)-2-heptadecenyl imidazoline. The imidazolines are primarily a mixture of diester of L-aspartic acid and an imidazoline based on the reaction between oleic acid and aminoethanolamine. Combinations of the rust inhibitors are used in the presence of a succinimide compound. However, no metal deactivator is used.

U.S. Pat. No. 4,088,587 relates to the use of a lubricating oil additive composition with improved antioxidant properties comprising sterically hindered phenols or thiophenols, oil soluble aromatic amines and an organic sulphur compound and a phosphorus containing compound. The sulphur containing compound contains 3 to 40 weight percent of sulphur in the form of a sulphide, polysulphides or mixtures thereof. Examples of sulphur compounds suitable include sulphurised fatty esters, sulphurised hydrocarbons and particularly useful are sulphurised metal phenates. The phosphorus compounds are prepared by reacting phosphorus oxychloride or phosphorus thiochloride with 1,2-substituted imidazolines. The phosphorus containing compounds do not contain amine functionality. Furthermore, no rust inhibitors are used.

U.S. Pat. No. 4,161,451 relates to the use of a composition which imparts improved oxidation properties to lubricants using an antioxidant selected from alkyl and aromatic sulphides and polysulphides, sulphurised oletins, sulfurised carboxylic acid esters and sulphurised ester olefins and a secondary aliphatic amine. Antioxidant properties are obtained by the synergistic effect from the sulphur containing antioxidant and the secondary aliphatic amine. In one embodiment, an oil soluble zinc salt is present and is used in combination with the sulphur containing antioxidant and the secondary aliphatic amine. The composition does not contain rust inhibitors.

U.S. Pat. No. 5,091,099 relates to the use of a phosphite free lubricating oil composition containing a mixture of at least one aromatic amine e.g. alkylated diphenylamine and at least one sterically hindered phenol. The composition does not contain a sulphurised antioxidant.

It would be desirable to produce a lubricating oil composition that does not substantially react with zinc and/or calcium and is capable of imparting acceptable levels of rust and/or oxidation inhibition without the formation of unwanted deposits that increases the viscosity of the fluid. Furthermore, it would be desirable to produce a lubricating oil composition capable of preventing filter plugging deposits and/or sludge in industrial fluids.

The present invention provides a lubricating oil composition capable of imparting good levels of rust and/or oxidation inhibition. The invention further provides a lubricating oil composition capable of preventing the formation of filter plugging deposits and sludge caused by acidic rust inhibitors in lubricating oils.

SUMMARY OF THE INVENTION

The invention relates to a lubricating oil composition comprising:

a) an oxidation package comprising:
   (i) an alkylated diphenylamine,
   (ii) a substituted hydrocarbyl monosulphide, and
   (iii)optionally, a sterically hindered phenol;

b) a rust inhibitor selected from the group comprising hydrocarbyl amine salts of alkylphosphoric acid, hydrocarbyl amine salts of dialkylphosphoric acid, hydrocarbyl amine salts of hydrocarbyl aryl sulphonic acid or mixtures thereof; and c) a metal deactivator;

d) optionally other additives; and e) an oil of lubricating viscosity.

The invention further provides a process for the preparation of lubricating oil compositions, comprises mixing and/or dissolving a metal deactivator, an oxidation package, at least one rust inhibitor, and optional additives selected from the group consisting of a foam inhibitor, demulsifier or a viscosity modifier or a pour point depressant and combinations thereof in a base oil or diluent oil.

The invention further provides a lubricating oil composition that is capable of preventing filter plugging deposits and sludge. The invention further provides for a lubricating oil composition with good levels of rust and/or oxidation inhibition without the detrimental effects of the formation of filter plugging deposits and sludge caused by acidic rust inhibitors in lubricating oils. The invention further provides a lubricating oil composition suitable for industrial fluids, hydraulic fluids, turbine oils and circulating oils.

DETAILED DESCRIPTION OF THE INVENTION

A novel lubricating oil composition has been found to prevent filter plugging deposits and sludge. This is achieved by using a lubricating oil composition comprising:

a) an oxidation package comprising:
   (i) an alkylated diphenylamine,
   (ii) a substituted hydrocarbyl monosulphide, and
   (iii) optionally, a sterically hindered phenol;

b) a rust inhibitor selected from the group comprising hydrocarbyl amine salts of alkylphosphoric acid, hydrocarbyl amine salts of dialkylphosphoric acid, hydrocarbyl amine salts of hydrocarbyl aryl sulphonic acid or mixtures thereof;

c) a metal deactivator;

d) optionally other additives; and e) an oil of lubricating viscosity.

Oxidation Package

The oxidation package includes but is not limited to alkylated diphenylamines that can be represented by the following formula:

(I)

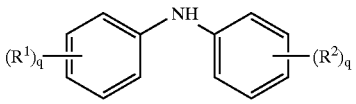

wherein $R^1$ and $R^2$ are independently hydrogen or an arylalkyl group containing about 5 to about 20, preferably about 6 to about 10 carbons atoms; or a linear or branched alkyl group containing 1 to 24 carbon atoms and q is independently 0, 1, 2, or 3, provided that at least one aromatic ring contains an arylalkyl group or a linear or branched alkyl group. $R^1$ and $R^2$ are alkyl groups containing from about 4 to about 20, preferably 5 to 16 and most preferably 6 to 12 carbon atoms. Preferred alkylated diphenylamines include but are not limited to bis-nonylated diphenylamine and bis-octylated diphenylamine.

The alkylated diphenylamines are present in the range from about 0.01 to about 13, preferably from about 0.02 to about 4, more preferably from about 0.03 to about 2.5, and most preferably from about 0.05 to about 1.5 weight percent of the lubricating oil composition. The alkylated diphenylamines may be used alone or mixtures thereof.

The oxidation package includes but is not limited to substituted hydrocarbyl monosulphides represented by the formula:

(II)

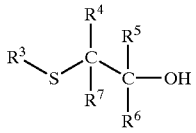

wherein $R^3$ is a saturated or unsaturated branched or linear alkyl group with about 8 to about 20, preferably about 9 to about 17, more preferably about 10 to about 15: and most preferably from about 11 to about 13 carbon atoms. $R^3$ can be branched or linear, but is preferably branched. $R^4$, $R^5$, $R^6$ and $R^7$ are independently hydrogen or alkyl containing about 1 to about 3, preferably about 1 to about 2 carbon atoms.

The substituted hydrocarbyl monosulphides include but are not limited to n-dodecyl-2-hydroxyethyl sulphide or 1-(tert-dodecylthio)-2-propanol and the like. The substituted hydrocarbyl monosulphide is preferably n-dodecyl-2-hydroxyethyl sulphide.

The substituted hydrocarbyl monosulphides are present in the range from about 0.01 to about 13, preferably from about 0.02 to about 4, more preferably from about 0.03 to about 2.5, and most preferably from about 0.05 to about 1.5 weight percent of the lubricating oil composition. The substituted hydrocarbyl monosulphides may be used alone or mixtures thereof.

The oxidation package optionally includes but is not limited to sterically hindered phenols represented by the formula:

(III)

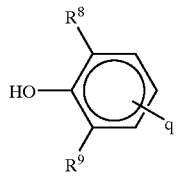

wherein $R^8$ and $R^9$ are independently branched or linear alkyl groups containing about 1 to about 24, preferably about 4 to about 18, and most preferably from about 4 to about 12 carbon atoms.

$R^8$ and $R^9$ may be either a straight or branched chain, branched is preferred. Preferably the phenol is butyl substituted containing two t-butyl groups. When the t-butyl groups occupy the 2,6-positions, the phenol is sterically hindered. q is hydrogen or hydrocarbyl. Examples of suitable hydrocarbyl groups include but are not limited to 2-ethylhexyl or n-butyl ester, dodecyl or mixtures thereof.

Other optional sterically hindered phenols suitable for the invention include but are not limited to those represented by the formulae:

(IV)

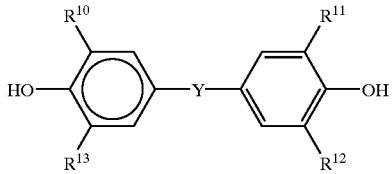

-continued (V)

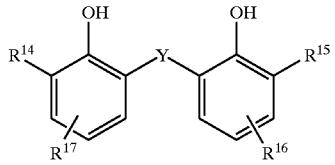

wherein $R^{10}$, $R^{11}$, $R^{12}$, $R^{13}$, $R^{14}$, $R^{15}$ are either straight or branched chain and contain about 4 to about 18, preferably from about 4 to about 12 carbon atoms. Preferably the phenol is butyl substituted.

$R^{16}$ and $R^{17}$ are independently hydrogen, an arylalkyl group or a linear or branched alkyl group. $R^{16}$ and $R^{17}$ are preferably in the para position. The arylalkyl or alkyl groups contain about 1 to about 15, preferably about 1 to about 10, and most preferably about 1 to about 5 carbon atoms. The bridging group Y includes but is not limited to —$CH_2$— (methylene bridge) or —$CH_2OCH_2$— (ether bridge).

Examples of methylene-bridged sterically hindered phenols include but are not limited to 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylene-bis(2,6-di-tertbutylphenol) or mixtures thereof.

In one embodiment the antioxidant is a hindered ester-substituted phenol represented by the formula:

(VI)

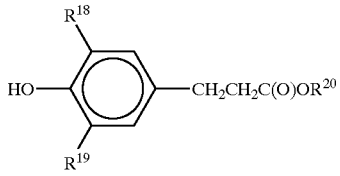

wherein $R^{18}$, $R^{19}$ and $R^{20}$ are straight or branched alkyl group containing about 2 to about 22, preferably about 2 to about 18, more preferably about 4 to about 8 carbon atoms. Specific examples include but are not limited to alkyl groups are 2-ethylhexyl or n-butyl ester, dodecyl or mixtures thereof.

The sterically hindered phenols present in the range from about 0 to about 13, preferably from about 0.02 to about 4, more preferably from about 0.03 to about 2.5, and most preferably from about 0.05 to about 1.5 weight percent of the lubricating oil composition. The sterically hindered phenols may be used alone or in combination.

Rust Inhibitor

Suitable rust inhibitors of the invention comprise at least one of hydrocarbyl amine salts of alkylphosphoric acid hydrocarbyl amine salts of dialkyldithiophosphoric acid, hydrocarbyl amine salts of hydrocarbyl aryl sulphonic acid or mixtures thereof.

The rust inhibitors of the invention include but are not limited to hydrocarbyl amine salts of alkylphosphoric acid, dihydrocarbyl amine salts of alkylphosphoric acid or hydrocarbyl amine salts of hydrocarbyl aryl sulphonic acid, preferably the rust inhibitor is an hydrocarbyl amine salt of alkylphosphoric acid or hydrocarbyl amine salts of hydrocarbyl aryl sulphonic acid. Suitable hydrocarbyl amine salts of alkylphosphoric acid of the invention are represented by the following formula:

(VII)

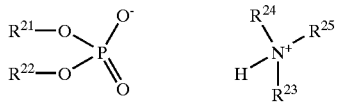

wherein $R^{21}$ and $R^{22}$ are independently hydrogen, alkyl chains or hydrocarbyl, preferably $R^{21}$ and/or $R^{22}$ are hydrocarbyl. $R^{21}$ and $R^{22}$ contain about 4 to about 30, preferably about 8 to about 25, more preferably about 10 to about 20, and most preferably about 13 to about 19 carbon atoms.

$R^{23}$, $R^{24}$ and $R^{25}$ are independently hydrogen, alkyl branched or linear alkyl chains with about 1 to about 30, preferably about 4 to about 24, even more preferably about 6 to about 20, and most preferably about 10 to about 16 carbon atoms. $R^{23}$, $R^{24}$ and $R^{25}$ are independently hydrogen, alkyl branched or linear alkyl chains, preferably at least one, and most preferably two of $R^{23}$, $R^{24}$ and $R^{25}$ are hydrogen.

Examples of alkyl groups suitable for $R^{23}$, $R^{24}$ and $R^{25}$ include but are not limited to butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonodecyl, eicosyl or mixtures thereof.

In one embodiment the hydrocarbyl amine salt of an alkylphosphoric acid is the reaction product of a $C_{14}$ to $C_{18}$ alkylated phosphoric acid with Primene 81R (produced and sold by Rohm & Haas) which is a mixture of $C_{11}$ to $C_{14}$ tertiary alkyl primary amines.

Hydrocarbyl amine salts of dialkyldithiophosphoric acid of the invention used in the rust inhibitor package are represented by the formula:

(VIII)

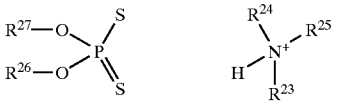

wherein $R^{26}$ and $R^{27}$ are independently branched or linear alkyl groups. $R^{26}$ and $R^{27}$ contain about 3 to about 30, preferably about 4 to about 25, more preferably about 5 to about 20, and most preferably about 6 to about 19 carbon atoms. $R^{23}$, $R^{24}$ and $R^{25}$ are as described above.

Examples of hydrocarbyl amine salts of dialkyldithiophosphoric acid of the invention include but are not limited to the reaction product(s) of heptylated or octylated or nonylated dithiophosphoric acids with ethylene diamine, morpholine or Primene 81R or mixtures thereof.

Suitable hydrocarbyl amine salts of hydrocarbyl aryl sulphonic acid used in the rust inhibitor package of the invention are be represented by the formula:

(IX)

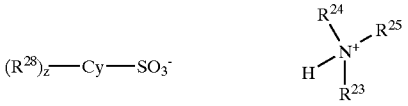

wherein Cy is a benzene or naphthalene ring. $R^{28}$ is a hydrocarbyl group with about 4 to about 30, preferably about 6 to about 25, more preferably about 8 to about 20 carbon atoms. z is independently 1, 2, 3, or 4 and most preferably z is 1 or 2. $R^{23}$, $R^{24}$ and $R^{25}$ are as described above.

Examples of hydrocarbyl amine salts of hydrocarbyl aryl sulphonic acid of the invention include but are not limited to the ethylene diamine salt of dinonyl naphthalene sulphonic acid.

The rust inhibitors of the invention are present in the range from about 0.001 to about 5, preferably from about 0.005 to about 1.5, more preferably from about 0.01 to about 0.75, even more preferably from about 0.02 to about 0.4, most preferably from about 0.05 to about 0.1 weight percent of the lubricating oil composition. The rust inhibitors of the invention may be used alone or mixtures thereof.

Metal Deactivators

Metal deactivators are used to neutralise the catalytic effect of metal for promoting oxidation in lubricating oil. Examples of metal deactivators include but are not limited to derivatives of benzotriazoles, benzimidazole, 2-alkyldithiobenzimidazoles, 2-alkyldithiobenzothiazoles, 2-(N,N-dialkyldithio-carbamoyl)benzothiazoles, 2,5-bis (alkyl-dithio)- 1,3,4-thiadiazoles, 2,5-bis(N,N-dialkyidithiocarbamoyl)-1,3,4-thiadiazoles, 2-alkyldithio-5-mercapto thiadiazoles or mixtures thereof.

Preferably the metal deactivator is a hydrocarbyl substituted benzotriazole compound. The benzotriazole compounds with hydrocarbyl substitutions include at least one of the following ring positions 1- or 2- or 4- or 5- or 6- or 7-benzotriazoles. The hydrocarbyl groups contain about 1 to about 30, preferably about 1 to about 15, more preferably about 1 to about 7 carbon atoms, and most preferably the metal deactivator is 5-methylbenzotriazole used alone or mixtures thereof.

The metal deactivators are present in the range from about 0.0001 to about 7, preferably from about 0.0005 to about 2, more preferably from about 0.00075 to about 1, even more preferably from about 0.001 to about 0.1 and most preferably from about 0.0015 to about 0.5 weight percent of the lubricating oil composition. The metal deactivator may be used alone or mixtures thereof.

Oil of Lubricating Viscosity

The lubricating oil compositions of the present invention include but are not limited to natural or synthetic oils of lubricating viscosity, oil derived from hydrocracking, hydrogenation, hydrofinishing, unrefined, refined and re-refined oils, and mixtures thereof.

Unrefined oils are those obtained directly from a natural or synthetic Source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include but are not limited to animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphtlhenic types and oils derived from coal or shale and mixtures thereof.

Synthetic lubricating oils are useful and include but are not limited to hydrocarbon oils such as polymerised and interpolymerised olefins (e.g., polybutylenes, polypropylenes, propyleneisobutylene copolymers,); poly (1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes, ); polyphenyls (e.g., biphenyls, terphenyls, alkylated polyphenyls, ); alkylated diphenyl ethers and alkylated diphenyl sulphides and the derivatives, analogs and homologs thereof and mixtures thereof.

Other synthetic lubricating oils include but are not limited to liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes.

Oils of lubricating viscosity can also be defined as specified in the American Petroleum Institute (API) Base Oil Interchangeability Guidelines. The five base oil groups are as follows: Group I sulphur content >0.03 wt %, and/or <90 wt % saturates, viscosity index 80–120; Group II sulphur content ≦0.03 wt %, and ≧90 wt % saturates, viscosity index 80–120; Group III sulphur content ≦0.03 wt %, and ≧90 wt % saturates, viscosity index ≧120; Group IV all polyalphaolefins (PAO's); and Group V all others not included in Groups I, II, III, or IV. In one embodiment the oil of lubricating viscosity comprises a Group II, III, IV, or mixtures thereof and preferably Group II.

The oil of lubricating viscosity is present in the range from about 60 to about 99.9, preferably from about 88.5 to 99.6, more preferably from about 96.9 to about 99.5 and most preferably from about 98.2 to about 99.4 weight percent of the lubricating oil composition. The oil of lubricating viscosity may be used alone or mixtures thereof.

The lubricating oil composition comprises an oxidation package that is in the range of about 0.01 to about 13 weight percent of the lubricating oil composition; and the rust inhibitor is in the range of about 0.001 to about 5 weight percent of the lubricating oil composition; and the metal deactivator is in the range about 0.0001 to about 7 weight percent of the lubricating oil composition; and the oil of lubricating viscosity is in the range about 60 to about 99.9 weight percent. The lubricating oil composition may also contain optional additives.

Optional Additives

Optionally the lubricating oil composition includes but is not limited to an additive selected from the group of a foam inhibitor, a demulsifier, a viscosity modifier, pour point depressants or mixtures thereof. The optional additives are present in the range from about 0 to about 13, preferably from about 0.00075 to about 5, more preferably from about 0.001 to about 0.4 and most preferably from about 0.0015 to about 0.2 weight percent of the lubricating oil composition. The optional additives may be used alone or mixtures thereof.

Foam Inhibitors

Foam inhibitors are known in the art and include but are not limited to organic silicones such as polyacetates, dimethyl silicone, polysiloxanes, polyacrylates or mixtures thereof.

Examples of foam inhibitors include but are not limited to poly ethyl acrylate, poly 2-ethylhexylacrylate, poly vinyl acetate and mixtures thereof.

Demulsifiers

Demulsifiers are known in the art and include but are not limited to derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof.

Examples of demulsifiers include trialkyl phosphates, polyethylene glycols, polyethylene oxides, polypropylene oxides, (ethylene oxide-propylene oxide) polymers and mixtures thereof.

Pour Point Depressants

Pour point depressants are known in the art and include but are not limited to esters of maleic anhydride-styrene copolymers, polymethacrylates; polyacrylates; polyacrylamides; condensation products of haloparaffin waxes and aromatic compounds; vinyl carboxylate polymers; and terpolymers of dialkylfumarates, vinyl esters of fatty acids, ethylene-vinyl acetate copolymers, alkyl phenol formaldehyde condensation resins, alkyl vinyl ethers and mixtures thereof.

Viscosity Modifiers

Pour point depressants are known in the art and include but are not limited to copolymers of styrene-butadiene rubbers, ethylene-propylene, polyisobutenes, hydrogenated styrene-isoprene polymers, hydrogenated radical isoprene polymers, polymethacrylate acid esters. polyacrylate acid esters, polyalkyl styrenes, alkenyl aryl conjugated diene copolymers, polyoletins, polyalkylmethacrylates, esters of maleic anhydride-styrene copolymers and mixtures thereof.

Process

The invention further provides a process for the preparation of lubricating oil compositions. The lubricating oil compositions are prepared by the steps comprising: a) mixing and/or dissolving a metal deactivator selected from the group comprising a hydrocarbyl substituted benzotriazole, 5-methylbenzotriazole and mixtures thereof in hydrocarbyl amine salts of alkylphosphoric acid hydrocarbyl amine salts of dialkylphosphoric acid, hydrocarbyl amine salts of hydrocarbyl aryl sulphonic acid or mixtures thereof until the metal deactivator is substantially or wholly dissolved at elevated temperatures in the range about 40° C. to about 110° C., preferably about 50° C. to 95° C. and most preferably about 55° C. to about 85° C.; and for a period of time in the range about 30 seconds to about 24 hours. preferably about 2 minutes to about 8 hours, and most preferably about 5 minutes to about 4 hours; and at pressures in the range about 700 mm of Hg to about 2000 mm of Hg, preferably about 750 mm of Hg to about 900 mm of Hg, and most preferably about 755 mm of Hg to about 800 mm of Hg. The resulting mixture is then mixed sequentially, separately or in combinations thereof with the oxidation package selected from the group comprising an alkylated diphenylamine, a substituted hydrocarbyl monosulphide and optionally a sterically hindered phenol; and the optional additives selected from the group of a foam inhibitor, a demulsifier or a viscosity modifier or a pour point depressant, and mixtures thereof at temperatures about 20° C. to about 140° C., preferably about 25° C. to 85° C. and most preferably about 30° C. to about 65° C. and at pressures in the range about 700 mm of Hg to about 2000 mm of Hg, preferably about 750 mm of Hg to about 900 mm of Hg, and most preferably about 755 mm of Hg to about 800 mm of Hg; for a period of time in the range about 1 minute to about 3 days, preferably about 5 minutes to about 8 hours, and most preferably about 10 minutes to about 4 hours. The resulting mixture is added with mixing to base oil or mixtures thereof by a known method.

The process produces a lubricating oil composition wherein the oxidation package is in the range of about 0.01 to about 13 weight percent of the lubricating oil composition; and the rust inhibitor is in the range of about 0.001 to about 5 weight percent of the lubricating; and the metal deactivator is in the range about 0.0001 to about 7 weight percent of the lubricating oil composition; and the oil of lubricating viscosity is in the range about 60 to about 99.9 weight percent.

In one embodiment the process comprises adding a sterically hindered phenol to the oxidation package in a range of about greater than 0 to about 13 weight percent of the lubricating oil composition; and further adding at least one additive selected from the group of a foam inhibitor, a demulsifier, a viscosity modifier a pour point depressant and mixtures thereof and are in the range about 0 to about 13 weight percent of the lubricating oil composition.

Alternatively the lubricating oil compositions may be prepared from a concentrate comprising the steps of:

a) mixing substantially all of a metal deactivator in hydrocalbyl amine salts selected from the group comprising of alkylphosphoric acid, hydrocarbyl amine salts of dialkylphosphoric acid, hydrocarbyl amine salts of hydrocarbyl aryl sulphonic acid or mixtures thereof, to form a mixture; and b) adding and mixing substantially all of the oxidation package selected from the group comprising an alkylated diphenylamine, a substituted hydrocarbyl monosulphide and mixtures thereof to the resultant mixture sequentially separately or combinations thereof; and c) adding with mixing to the resultant mixture a sufficient portion of the base oil or mixtures thereof to form a concentrate of the lubricating oil composition by known methods employing the reaction conditions mentioned above. The process further comprises adding the concentrate from step (c) to an effective amount of base oil or mixtures thereof resulting in a finished fluid. Optional additives may be added selected from the group of a foam inhibitor, a demulsifier or a viscosity modifier or a pour point depressant into base oil or mixtures thereof into base oil or mixtures thereof in the range about 0 to about 13 weight percent of the lubricating oil composition by known methods.

Concentrate

The novel lubricating oil composition can be made as a concentrate. The concentrate comprises:

a) an oxidation package comprising:
   (i) an alkylated diphenylamine,
   (ii) a substituted hydrocarbyl monosulphide, and
   (iii) an optionally a sterically hindered phenol;

b) a rust inhibitor is selected from the group comprising hydrocarbyl amine salts of alkylphosphoric acid, hydrocarbyl amine salts of dialkylphosphoric acid, hydrocarbyl amine salts of hydrocarbyl aryl sulphonic acid or mixtures thereof;

c) a metal deactivator;

d) optionally other additives; and e) a sufficient portion of the base oil or mixtures thereof to form a concentrate.

The oxidation package, a rust inhibitor, a metal deactivator and optional additives are combined with a small portion of base oil and when ready to use is combined with the remaining substantial amount of base oil.

The oxidation package is present in the concentrate in the range from about 0.1 to about 99.9, preferably from about 0.4 to about 99.8, more preferably from about 2.9 to about 98.7 and most preferably from about 8.5 to about 94.3 weight percent of the performance package or mixtures thereof.

The rust inhibitor is present in the concentrate in the range from about 0.01 to about 99.7, preferably from about 0.09 to about 98.6, more preferably from about 0.1 to about 95.9 and most preferably from about 3.1 to about 87.8 weight percent of the performance package or mixtures thereof.

The metal deactivator is present in the concentrate in the range from about 0.001 to about 98.8, preferably from about 0.007 to about 98.7, more preferably from about 0.1 to about 96 and most preferably from about 0.2 to about 85.5 weight percent of the performance package or mixtures thereof.

The optional other additives are present in the concentrate in the range about from 0 to about 99.9, preferably from about 0.02 to about 99.5, more preferably from about 0.1 to about 90.7 and most preferably from about 2.5 to about 73.8 weight percent of the performance package or mixtures thereof.

Industrial Application

The lubricating oil composition is used in industrial fluids, hydraulic fluids, turbine oils and circulating oils and combinations thereof wherein the composition comprises:

a) an oxidation package comprising:
   (i) an alkylated diphenylamine,
   (ii) a substituted hydrocarbyl monosulphide,
   (iii) about 0 to about 13 weight percent of the lubricating oil composition includes a sterically hindered phenol;

b) a rust inhibitor selected from the group comprising hydrocarbyl amine salts of alkylphosphoric acid, hydrocarbyl amine salts of dialkylphosphoric acid, hydrocarbyl amine salts of hydrocarbyl aryl sulphonic acid or mixtures thereof;

c) a metal deactivator; and d) an oil of lubricating viscosity. Optionally the lubricating oil composition comprises additives selected from the group comprising a foam inhibitor, a demulsifier, a pour point depressant, a viscosity modifier and mixtures thereof.

In one embodiment of the invention the lubricating oil composition may be used in turbine oils. The use of the lubricating oil composition prevents the formation of filter plugging deposits and sludge in turbines. The invention further provides a lubricating oil composition used in a turbine, wherein the lubricating oil composition comprises an oxidation package, at least one rust inhibitor, a metal deactivator, an oil of lubricating viscosity and optionally other additives. The invention further provides a lubricating oil composition with at least one improved property selected from rust inhibition, oxidation inhibition and mixtures thereof. The invention further provides a lubricating oil composition that does not substantially react with zinc and/or calcium thereby preventing the formation of sludge and particulate material that accumulates plugging the fine filters.

The following examples provide an illustration of the invention. It should however be noted that these examples are non exhaustive and not intended to limit the scope of the invention.

SPECIFIC EMBODIMENT

EXAMPLES

Examples 1 to 6 and Comparative Example 1 (C1)

For all examples the oil formulations are prepared containing 90 percent of 220N API Group 2 base oil, 6.49 $mm^2s^{-1}$ (cSt) at 100° C. and 10 percent of 600N Group 2 base oil, 12.2 $mm^2s^{-1}$ (cSt) at 100° C. Components A to J are A=Alkylated diphenylamine, B=1-(tert-dodecylthio)-2-propanol, C=n-dodecyl 2-hydroxyethyl sulphide, D=butylated sterically hindered phenol, E=hydrocarbyl amine salts of alkylphosphoric acid, F=Irgacor L17 (produced and sold by Ciba Specialty Chemicals), G=ethylene diamine salt of dinonyl naphthalene sulphonic acid, H=5-Methylbenzotriazole, I=ethylene oxide-propylene oxide copolymer (BASF Pluradyne FL11) and J=(2-Ethylhexyl/Ethyl) acrylate copolymer.

Components A–D constitute the oxidation inhibitor package, components E–G constitute the ruSt inhibitors, H is the metal deactivator, I is a demulsifier and J is a foam inhibitor. The compositions prepared are listed in Table 1 below:

TABLE 1

Lubricating Oil Compositions of the Invention

| | Components (wt % of the lubricating oil composition) | | | | | | | | | |
|---|---|---|---|---|---|---|---|---|---|---|
| Examples | A | B | C | D | E | F | G | H | I | J |
| C1 | 0.375 | | 0.09 | | | 0.025 | | | | |
| 1 | 0.375 | | 0.09 | | | | 0.0499 | 0.002 | | |
| 2 | 0.375 | | 0.09 | | | | 0.0499 | 0.002 | | |
| 3 | 0.375 | 0.09 | | | 0.05 | | | 0.002 | 0.004 | 0.02 |
| 4 | 0.7499 | 0.1799 | | | 0.05 | | | 0.002 | 0.004 | 0.02 |
| 5 | 0.375 | 0.09 | | | 0.1 | | | 0.002 | 0.004 | 0.02 |
| 6 | 0.125 | | 0.162 | 0.138 | | | | 0.002 | | |

Test 1

The ASTM D2272 test measures the oxidation life of oils. The test oil, water and a copper catalyst coil are contained in a covered glass container and placed in vessel (rotating bomb unit). The vessel is charged with oxygen at about 90 psi and placed in an oil bath heated to about 150° C. The vessel is rotated axially at about 100 rpm at and angle of about 30° from the horizontal. The oxidation life is measured by recording the time taken for the reactor to decrease in pressure by about 25.4 psi. The minimum time required for an oil formulation to pass the GEK 32568E test is about 500 minutes. The results (Original Time (mins)) obtained for oil compositions with antioxidants are in Table 2 below:

TABLE 2

ASTM D2272 Results

| Example | Original Time (mins) | Time (mins) Nitrogen Heated Sample in Modified D2272 Test | % of Original Time Retained |
|---|---|---|---|
| C1 | 268 | | |
| 1 | 1073 | | |
| 2 | 917 | | |
| 3 | 607 | 555 | 91.4 |
| 4 | 1210 | 1063 | 87.9 |
| 5 | 571 | 500 | 87.6 |
| 6 | 578 | | |

Examples 1–6 passed the ASTM D2272 test and demonstrated that the combination of the oxidation package, rust inhibitors and metal deactivator produce a lubricant formulation that exceeds the minimum 500 minutes required by the GEK 32568E test. Comparative Example 1 failed to pass the ASTM D2272 with a time of 268 minutes. The failure of Comparative Example 1 is believed to be because it does not contain a metal deactivator.

A modified D2272 analysis is carried out on compositions that have been heat treated under a nitrogen stream at about 121° C. for about 48 hours. The heat treatment allowed volatile additives to be removed by evaporation. This test is designed to simulate the remaining oxidation life of in-service oils. The minimum oxidation life of the heated sample is about 85% of the recorded time for the original "new" sample. The results obtained are shown in Table 2 in columns "Time (mins) Nitrogen Heated Sample in D2272 Test"; and "% of Original Time Retained."

The results indicate that all of the samples tested in the modified D2272 analysis were able to retain at least about 85% of the value obtained for the original oil, thus demonstrating that the oil was not formulated with volatile antioxidants. As non-volatile antioxidants were used the useful oxidation life of oil is increased (where "useful" is defined as the length of time for the oil to lose its antioxidant properties).

Test 2

The ASTM D665 test measures the rust preventing characteristics of oil in the presence of water. A steel pin about 12.7 mm in diameter and about 68 mm across exclusive of the threaded portion is screwed to a plastic holder. The steel pin is immersed in a beaker of distilled water. The beaker is placed in an oil bath held at about 60° C. and the contents of the beaker are stirred for about 24 hours. The amount of corrosion/rust is measured. The procedure is repeated using synthetic seawater and a new steel pin.

To meet current requirements of GEK 32568E test the steel pin must pass a corrosion test in distilled water and synthetic seawater. All Examples 1–6 pass the D665 test. Examples 1–6 have lubricating oil compositions with sufficient antioxidant and rust inhibition protection to pass the distilled water and synthetic seawater pin rating.

Overall the tests illustrate that the lubricating oil compositions provide in-service oils with the desired degree of rust inhibition, and the oxidation life required to pass the GEK 32568E test.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating oil composition comprising:

a) an oxidation package comprising:
(i) an alkylated diphenylamine,
(ii) a substituted hydrocarbyl monosulphide, and
(iii) optionally, a sterically hindered phenol;

b) a rust inhibitor selected from the group comprising hydrocarbyl amine salts of alkylphosphoric acid, hydrocarbyl amine salts of dialkylphosphoric acid, hydrocarbyl amine salts of hydrocarbyl aryl suiphonic acid or mixtures thereof;

c) a metal deactivator;

d) optionally other additives; and e) an oil of lubricating viscosity.

2. The lubricating composition of claim 1 further comprising at least one additive selected from the group comprising a foam inhibitor, a demulsifier, a viscosity modifier, a pour point depressant and mixtures thereof.

3. The lubricating composition of claim 1, wherein the oxidation package is in the range of about 0.01 to about 13 weight percent of the lubricating oil composition; and the rust inhibitor is in the range of about 0.001 to about 5 weight percent of the lubricating oil composition; and the metal deactivator is in the range about 0.0001 to about 7 weight percent of the lubricating oil composition; and the oil of lubricating viscosity is in the range about 60 to about 99.9 weight percent.

4. The lubricating composition of claim 1, wherein the alkylated diphenylamine is represented by the formula:

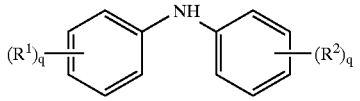

wherein $R^1$ and $R^2$ are independently a hydrogen or an arylalkyl group containing about 5 to 20 carbon atoms; or a linear or branched alkyl group containing 1 to 24 carbon atoms and q is independently 0, 1, 2, or 3, provided that at least one aromatic ring contains an arylalkyl group or a linear or branched alkyl group.

5. The lubricating composition of claim 1, wherein the substituted hydrocarbyl monosulphides are represented by the formula:

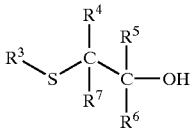

wherein $R^3$ is a saturated or unsaturated branched or linear alkyl group with about 8 to about 20 carbon atoms; $R^4$, $R^5$, $R^6$ and $R^7$ are independently hydrogen or alkyl containing about 1 to about 3 carbon atoms.

6. The lubricating composition of claim 5, wherein the substituted hydrocarbyl monosulphide is n-dodecyl 2-hydroxyethyl sulphide, 1-(tert-dodecylthio)-2-propanol, and mixtures thereof.

7. The lubricating composition of claim 1, wherein the sterically hindered phenol is present and is represented by the formula:

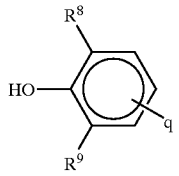

wherein $R^8$ and $R^9$ are independently branched or linear alkyl groups containing about 1 to about 24 carbon atoms; q is hydrogen or hydrocarbyl.

8. The lubricating composition of claim 1, wherein the hydrocarbyl amine salts of alkylphosphoric acid are represented by the formula:

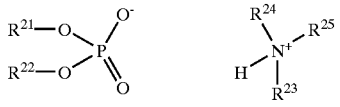

wherein $R^{21}$ and $R^{22}$ are independently hydrogen, alkyl chains or hydrocalbyl; $R^{21}$ and $R^{22}$ contain about 4 to about 30 carbon atoms: $R^{23}$, $R^{24}$ and $R^{25}$ are independently hydrogen, alkyl branched or linear alkyl chains with about 1 to about 30 carbons atoms.

9. The lubricating composition of claim 1, wherein the hydrocarbyl amine salts of dialkyldithiophosphoric acid are represented by the formula:

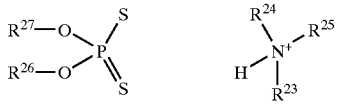

wherein $R^{26}$ and $R^{27}$ are independently branched or linear alkyl groups and contain about 3 to about 30 carbon atoms; $R^{23}$, $R^{24}$ and $R^{25}$ are independently hydrogen. alkyl branched or linear alkyl chains with about 1 to about 30 carbons atoms.

10. The lubricating composition of claim 1, wherein the hydrocarbyl amine salts of hydrocarbyl aryl sulphonic acid are represented by the formula:

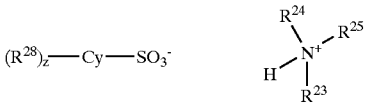

wherein Cy is a benzene or naphthalene ring, $R^{28}$ is a hydrocarbyl group with about 4 to about 30 carbon atoms, z is independently 1, 2, 3, or 4; $R^{23}$, $R^{24}$ and $R^{25}$ are independently hydrogen, alkyl branched or linear alkyl chains with about 1 to about 30 carbons atoms.

11. The lubricating composition of claim 1, wherein the metal deactivator is selected from the group comprising hydrocarbyl substituted benzotriazole, 5-methylbenzotriazole and mixtures thereof.

12. The composition of claim 2, wherein the additives are in the range about 0 to about 13 weight percent.

13. The lubricating composition of claim 1, wherein the composition has at least one improved property selected from the group comprising rust inhibition, oxidation inhibition, and mixtures thereof and does not substantially react with zinc and/or calcium thus preventing the formation of sludge and particulate material in filters.

14. A process to prepare a lubricating oil composition comprising the steps of:

a) mixing a metal deactivator selected from the group comprising hydrocarbyl substituted benzotriazole, 5-methylbenzotriazole and mixtures thereof, in hydrocarbyl amine salts selected from the group consisting of alkylphosphoric acid. hydrocarbyl amine salts of dialkylphosphoric acid, hydrocarbyl amine salts of hydrocarbyl aryl sulphonic acid or mixtures thereof; and b) adding and mixing the oxidation package selected from the group comprising an alkylated diphenylamine, a substituted hydrocarbyl monosulphide and mixtures thereof to the resultant mixture sequentially, separately or combinations thereof; and c) adding and mixing the resultant mixture into the base oil or mixtures thereof.

15. The process of claim 14, wherein the oxidation package is in the range of about 0.01 to about 13 weight percent of the lubricating oil composition; and the rust inhibitor is in the range of about 0.001 to about 5 weight percent of the lubricating oil composition; and the metal deactivator is in the range about 0.0001 to about 7 weight percent of the lubricating oil composition; and the oil of lubricating viscosity is in the range about 60 to about 99.9 weight percent.

16. The process of claim 14 further comprising adding a sterically hindered phenol to step (b) in a range of about greater than 0 to about 13 weight percent of the lubricating oil composition and further adding to steps (b) and/or (c) at least one additive selected from the group comprising a foam inhibitor, a demulsifier, a viscosity modifier a pour point depressant and mixtures thereof and are in the range about 0 to about 13 weight percent of the lubricating oil composition.

17. A process to prepare a concentrate of a lubricating oil composition comprising the steps of:

a) mixing substantially all of a metal deactivator in hydrocarbyl amine salts selected from the group comprising of alkylphosphoric acid, hydrocarbyl amine salts of dialkylphosphoric acid, hydrocarbyl amine salts of hydrocarbyl aryl sulphonic acid or mixtures thereof to form a mixture; and b) adding and mixing substantially all of the oxidation package selected from the group comprising an alkylated diphenylamine, a substituted hydrocarbyl monosulphide and mixtures thereof to the resultant mixture sequentially, separately or combinations thereof; and c) adding with mixing to the resultant mixture a sufficient portion of the base oil or mixtures thereof to form a concentrate of the lubricating oil composition.

18. The process of claim 17 further comprising adding the concentrate from step (c) to an effective amount of base oil or mixtures thereof resulting in a finished fluid.

19. The process of claim 17 further comprising adding additives selected from the group comprising a foam inhibitor, a demulsifier, a viscosity modifier, a pour point depressant and combinations thereof into the base oil or mixtures thereof wherein the additives are in the range about 0 to about 13 weight percent of the lubricating oil composition.

20. A lubricating oil composition for use as an industrial fluid, hydraulic fluid, turbine oil, circulating oil or combinations thereof wherein the lubricating oil composition comprises:

a) an oxidation package comprising:
   (i) an alkylated diphenylamine,
   (ii) a substituted hydrocarbyl monosulphide,
   (iii) about 0 to about 10 weight percent of a sterically hindered phenol b) a rust inhibitor selected from the group comprising hydrocarbyl amine salts of alkylphosphoric acid, hydrocarbyl amine salts of dialkylphosphoric acid, hydrocarbyl amine salts of hydrocarbyl aryl sulphonic acid or mixtures thereof;

c) a metal deactivator; and d) an oil of lubricating viscosity.

* * * * *